United States Patent [19]

Dobson

[11] 4,028,834

[45] June 14, 1977

[54] SPENT CARTRIDGE COLLECTOR

[76] Inventor: Allan E. Dobson, 4653 Beverly Blvd., Los Angeles, Calif. 90004

[22] Filed: Feb. 26, 1976

[21] Appl. No.: 661,442

[52] U.S. Cl. ..... 42/1 T
[51] Int. Cl.[2] ..... F41C 27/00
[58] Field of Search ..... 42/1 T

[56] References Cited

UNITED STATES PATENTS

| | | | |
|---|---|---|---|
| 663,262 | 12/1900 | Dieterich | 42/1 T |
| 1,201,189 | 10/1916 | Johnson | 42/1 T |
| 1,304,468 | 5/1919 | Fernandez | 42/1 T |
| 2,354,277 | 7/1944 | Richardson | 42/1 T |
| 2,866,289 | 12/1958 | Wilcox | 42/1 T |
| 3,156,991 | 11/1964 | Adams | 42/1 T |
| 3,739,685 | 6/1973 | Lundgren | 42/1 T |

FOREIGN PATENTS OR APPLICATIONS

| | | | |
|---|---|---|---|
| 2,424,719 | 5/1974 | Germany | 42/1 T |

*Primary Examiner*—Charles T. Jordan

[57] ABSTRACT

A cartridge collector comprising a rectangular shell having a lateral opening and a bottom opening and including securing means along the lateral opening, for aligning said shell over the ejection port of a rifle. Formed along the transverse edges of the bottom opening are two opposed grooves within which a removable storage receptacle is inserted. The storage receptacle comprises a wire frame enclosed along the lateral and bottom surfaces by a wire mesh and conformed at the upper surface to form an opening receivable within the grooves. In this manner the spent and ejected cartridges are directed by the shell to drop into the removable receptacle where the cartridges are collected for convenient return to one central collection facility.

5 Claims, 7 Drawing Figures

SPENT CARTRIDGE COLLECTOR

BACKGROUND OF THE INVENTION

1. Field of the Invention

The present invention relates to cartridge collection apparatus and more particularly to cartridge collectors adapted for use with automatic and semi-automatic firearms.

2. Description of the Prior Art

During firearm practice and particularly during the training period of military personnel, one of the more basic events is that of shooting at a target. In order to develop and maintain proficiency in firearm use, such target practice is normally engaged on a repetitive basis with a resulting large expenditure in the number of cartridges used. Since the standard firearm now adopted by the military branches is capable of both semi-automatic and fully automatic use at the selection of the user, such target practice necessarily also entails periods of practice when automatic firing techniques are exercised. Thus, as the use of automatic rifles becomes common place, the concurrent use of cartridges per user has risen commensurately. In the past, the spent cartridges were normally ejected from the firearm and were thus free to drop onto the ground to be collected or abandoned at the choice of the user. Since one of the major costs in a cartridge is the cost of the cartridge casing itself and since such spent casings were very often abandoned, the cost of target practice has become increasingly more expensive.

SUMMARY OF THE INVENTION

Accordingly, it is the general purpose and object of the present invention to provide a device which can be conveniently mounted onto a firearm, such device providing a collection cavity for the spent cartridges.

Other objects of the invention are to provide a spent cartridge collector which can be conveniently attached to various firearms and which include a removable collection receptacle which is periodically emptied without disrupting the attachment of the collector to the firearm.

Yet further objects of the invention are to provide a spent cartridge collector which is easy to producwe, requires few parts and is therefore simple and reliable in use.

Briefly, these and other objects are accomplished within the present invention by providing a rectangular shell open along one lateral surface and along a bottom surface thereof. Disposed along the top edge of the lateral opening is a hanger bracket formed in a manner of a downwardly opened channel, such bracket being conformed to the exterior dimension of a typical bolt housing in a firearm. In this manner, the ejection shell can be disposed to align the lateral opening thereof over the ejection port of the firearm to thereby control the ejection trajectory of the spent cartridge into the bottom opening. Formed distal of one vertical edge of the lateral opening is a clamping device which either is springbiased or surrounds the corresponding segment of the firearm to thus secure the ejection shell relative the ejection port. In order to facilitate collection of spent shells and periodic removal thereof from the spent cartridge collector, there are included along the lateral edges of the bottom opening, two opposed grooves into which projecting edges of a removable storage receptacle are received. The removable storage receptacle comprises a wire frame formed to provide a rectangular opening which is insertable between the grooves, such rectangular opening having suspended therefrom, a downwardly directed cage enclosed by wire mesh. This manner of assembly provides a convenient visual indication of the amount of cartridges accumulated within the receptacle and a convenient means of inserting and withdrawing the receptacle for periodic removal of the collected casings.

DESCRIPTION OF THE SPECIFIC EMBODIMENTS

While the following description illustrates the inventive cartridge collector in use with a military firearm, such illustration is for descriptive purposes only. It is to be understood that uses other than those shown may be apparent to those skilled in the art and no intent to limit the scope of the present invention is expressed by the choice of illustration herein.

Figure 1:
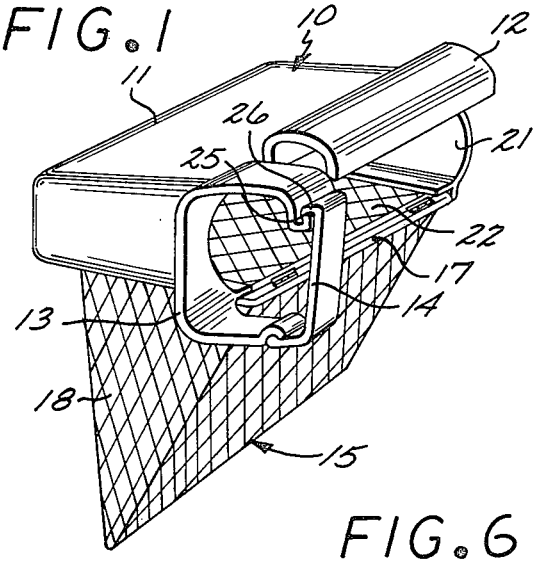
FIG. 1 is a perspective illustration of a spent cartridge collector constructed according to the present invention.
Figure 2:
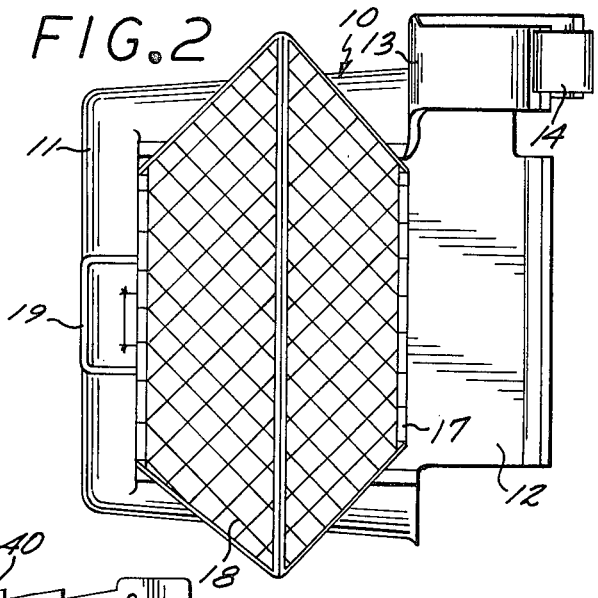
FIG. 2 is a bottom view of the cartridge collector illustrated in FIG. 1.

As shown in FIGS. 1 and 2, the inventive spent cartridge collector, generally designated by the numeral 10, comprises a rectangular, thin-walled, ejection shell 11 including a lateral opening 21 and a bottom opening 22, respectively formed in the lateral and bottom surfaces thereof. Formed along the upper, longitudinal edge of the lateral opening 21 is a hanger bracket 12 generally formed in the manner of an inverted channel joined to the shell 11 along one edge thereof. As will be described further hereinbelow, the central cavity or the width of the hanger bracket 12 is formed to receive the upper surface of the bolt housing in a firearm, the collector 10 housing thus supported in alignment over the ejection port thereof. Attached to the vertical front edge of opening 21 is a clamping frame 13 generally C-shaped in section, the attachment thereof being made at the central segment of the C. Formed at the end of one edge of the clamping frame 13 is an exteriorly projecting lip 25 which is adapted for engagement of an interiorly projecting lip 26 formed on the free end of a hinged clamp 14 pivotally attached to the other leg of the frame 13. By way of this arrangement of parts, the cartridge collector 10 is supported by the hanger bracket 12 from the bolt housing of a firearm, being secured in this arrangement by the closure of clamp 14 over the projecting lip 25. In this position, any cartridges ejected from the firearm will enter the interior of shell 11 which thus controls the trajectory thereof towards the opening 22.

Disposed below openig 22 and in position to capture the cartridgs dropping therethrough is a removable storage receptacle 15 comprising a rectangular edge frame 17 dimensioned to be received within two opposed grooves 16 formed along the lateral exterior edges of opening 22. Attached to the longitudinal segments of frame 17 is again a wire cage 20 wrapped by wire mesh fabric 18 to form an enclosure for collecting the spent cartridges. This arrangement of parts allows for the withdrawal of the frame 17 from within the opposed grooves 16 to thus periodically clear the accumulated cartridges therein. To facilitate such withdrawal, there is formed along one longitudinal segment of the wire frame 17 a handle 19.

Figure 3:
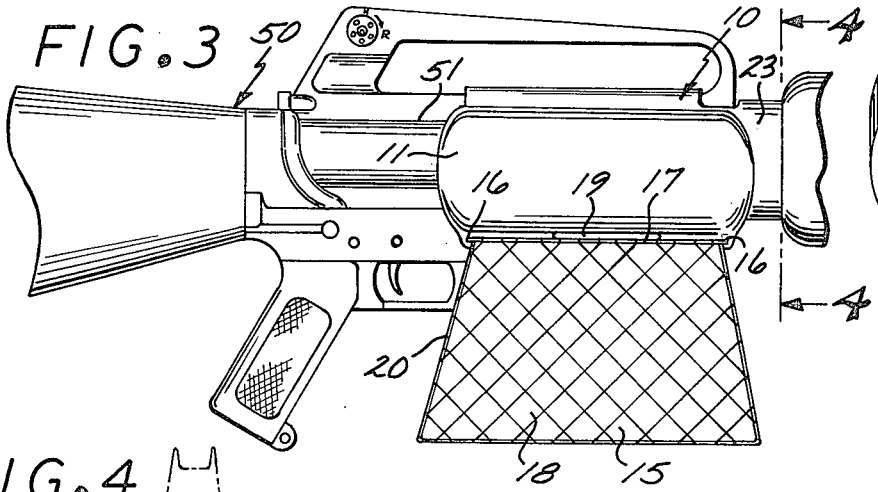
FIG. 3 is a side view of the collector shown in FIG. 1 as attached over the ejection port of a firearm.
Figure 4:
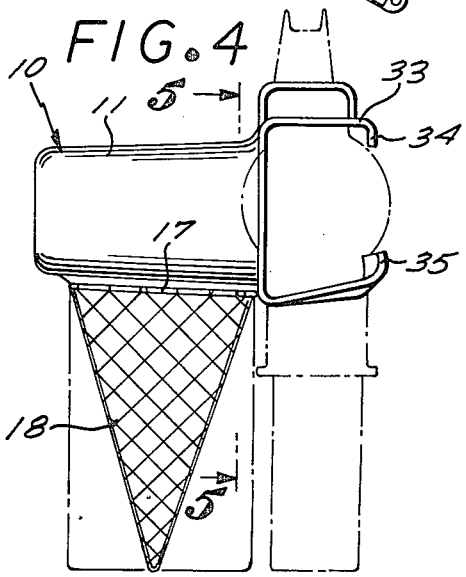
FIG. 4 is a front view of the inventive cartridge collector illustrating one attachment variance thereof.
Figure 5:
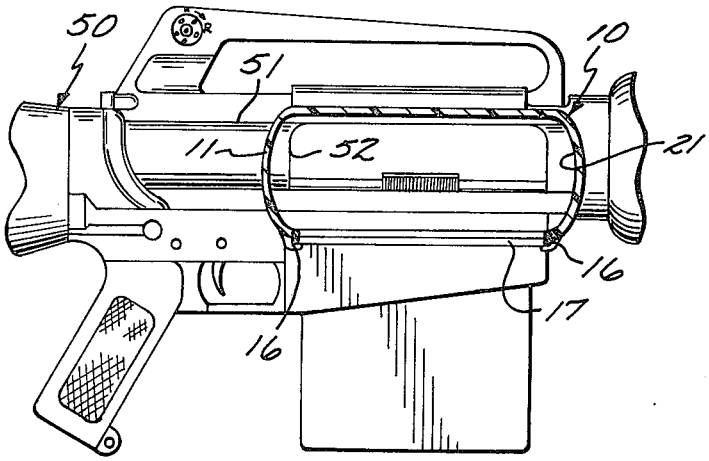
FIG. 5 is a side view in partial cross-section taken along line 5—5 of FIG. 4.

As illustrated in FIGS. 3, 4 and 5, the disposition of the cartridge collector 10 relative a military firearm 50 is controlled by the arrangement of hanger bracket 12 relative the bolt housing 51 of the firearm. By specific reference to FIG. 5, the arrangement of shell 11 is such that the ejection port shown herein as ejection port 52 associated with the firearm is completely enclosed by the structure of the shell. Thus, the spent casing is ejected through ports 52 and the adjacent opening 21 into the interior of the shell 11 to collide with the opposing walls of the shell. To provide for a convenient energy absorption technique of the collision described immediately above, it is intended that the shell 11 be constructed from a deformable material such as plastic or rubber which, by virtue of its low modulous of elasticity, will attenuate most of the high frequency components of collision. In this manner, most of the kinetic energy of the cartridge is taken out and the cartridge is then directed by the forces of gravity to drop into the removable storage receptacle disposed below the opening 22.

While specific reference has been made to FIGS. 3, 4 and 5 for the manner of arrangement of the collector 10 relative a firearm 50, these same figures illustrate yet another embodiment of a clamping frame which may be substituted for the clamping frame 13 shown in FIGS. 1 and 2. Specifically, as illustrated in FIG. 4, a spring-loaded clamping frame 33 is shown in replacement for the clamping frame 13, frame 33 comprising, again, a C-shaped section joined at the central segment thereof to the front, vertical edge of opening 21. Formed at the free end of the legs of the frame 33, are two inwardly directed lips 34 and 35, respectively which are separated by a gap smaller than the corresponding dimension of the firearm segment received within the clamps. It is further intended that clamps 33 be partly elastic and thus insertion and withdrawal of the firearm may be accommodated by the flexure thereof.

Figure 6:
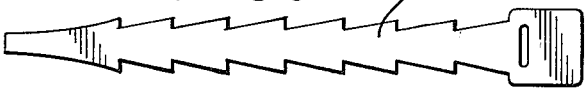
FIG. 6 is a plan view of a securing strap useful with the present invention.
Figure 7:
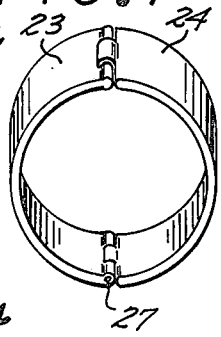
FIG. 7 is a partial view in perspective illustrating yet another attachment variance adapted for use with the present invention.

In the alternative, a clamping device such as shown in FIG. 7, can be utilized for the same purpose. Specifically shown in FIG. 7 is a semi-circular clamping frame 23 which, again, is attached in a manner similar to frame 13 which is joined by corresponding pins 27 to one end of a semi-circular clamp 24. In this manner, a hinged clamp is formed which may be secured in a closed position by a securing strap such as the securing strap 40 shown in FIG. 6.

Referring back to FIGS. 1, 2, 3 and 4, the shape of the wired cage 20 is essentially triangular to thus facilitate stacking of a plurality of receptacles 15. Should stacking not be required, other shapes, such as for example the shape shown by the dashed line in FIG. 5, may be achieved accommodating various numbers of spent cartridges.

Some of the many advantages of the present invention should now be apparent from the above teachings. The invention provides means for collecting spent cartridges heretofore abandoned by way of a structure which is easy to produce, requires few parts and is simple and reliable in use. This the invention provides by way of a convenient structure disposed in a manner presenting no additional burden to the user.

Obviously many modifications and variations to the above disclosure can be made without departing from the spirit of the invention. It is therefore intended that the scope of the invention be determined solely dependent on the claims hereto.

I claim:

1. In combination with a firearm that has an ejection port from which spent cartridge shells are discharged, an apparatus for collecting spent cartridge shells ejected from said ejection port, said apparatus comprising:

a. hollow enclosure defining means formed from a thin wall sheet material, said hollow enclosure defining means having an upper surface, a lateral surface and a bottom surface, a first opening in said lateral surface that surrounds said ejection port, a second opening in said bottom surface, and two opposed grooves formed on the exterior of said bottom surface and disposed along two opposed edges of said second opening;

b. hanger means attached to said hollow enclosure defining means adjacent said first opening, said hanger means extending away from said hollow enclosure defining means along a plane substantially coincident with said upper surface, said hanger means so removably engaging said firearm that said hollow enclosure defining means is removably supporting from said firearm with said first opening in alignment with said ejection port;

c. receptacle means releasably secured to said hollow enclosure defining means in a position below said second opening for collecting said spent cartridge shells therein, said receptacle means including projections formed thereon for slidable receipt within said grooves, and said receptacle means comprising a rectangular frame having two first opposed segments that define projections for receipt in said grooves, a wire cage extending from said frame, and a wire mesh wrapping surrounding said cage; and d. securing means attached to said hollow enclosure defining means for attachment of the latter to said firearm.

2. Apparatus according to claim 1 wherein:

said securing means comprises a C-shaped frame attached to said hollow enclosure defining means and conformed to partly surround a selected section of said firearm and a clamp pivotally mounted to one end of said C-shaped frame for surrounding said firearm.

3. Apparatus according to claim 2 further comprising:

engagement means formed on the free end of said clamp and said C-shaped frame for securing said clamp to said C-shaped frame.

4. Apparatus according to claim 2 further comprising:

a securing strap adapted to surround said C-shaped frame and said clamp.

5. Apparatus according to claim 1 wherein:

said securing means includes a flexible C-shaped frame connected to said hollow enclosure defining means for partly surrounding a selected section of said firearm, having formed at the free ends thereof projecting extensions directed towards each other, the ends of said extensions being separated by a gap smaller than the corresponding sectional dimension of said firearm.

* * * * *